US008591013B2

(12) United States Patent
Rittgers et al.

(10) Patent No.: US 8,591,013 B2
(45) Date of Patent: Nov. 26, 2013

(54) FLUID INTERCONNECTION

(75) Inventors: Jon Rittgers, Celbridge (IE); Mark Loughlin, Churchtown (IE); Eduardo Macias, Clonee (IE); Patricia Ryan, Dublin (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 280 days.

(21) Appl. No.: 12/936,504

(22) PCT Filed: Apr. 7, 2008

(86) PCT No.: PCT/US2008/059545

§ 371 (c)(1),
(2), (4) Date: Oct. 5, 2010

(87) PCT Pub. No.: WO2009/126137

PCT Pub. Date: Oct. 15, 2009

(65) Prior Publication Data

US 2011/0025788 A1 Feb. 3, 2011

(51) Int. Cl.
*B41J 2/175* (2006.01)
*B41J 2/17* (2006.01)

(52) U.S. Cl.
USPC ..... 347/85; 347/84

(58) Field of Classification Search
USPC ..... 347/84, 85
See application file for complete search history.

(56) References Cited

U.S. PATENT DOCUMENTS

| | | | |
|---|---|---|---|
| 5,949,458 | A | 9/1999 | Studholme |
| 6,082,852 | A | 7/2000 | Soga et al. |
| 6,450,630 | B2 | 9/2002 | Kanaya et al. |
| 2006/0132561 | A1 | 6/2006 | Anderson, Jr. et al. |
| 2006/0227182 | A1 | 10/2006 | Greer et al. |

FOREIGN PATENT DOCUMENTS

| | | |
|---|---|---|
| JP | 10-086398 | 4/1998 |
| JP | 2003-305869 A | 10/2003 |

*Primary Examiner* — Jannelle M Lebron

(57) ABSTRACT

In one embodiment, a fluid interconnection between a fluid container and a fluid ejector assembly includes: a first wick at an outlet from the container, the first wick having an upstream surface and a downstream surface; a second wick at an inlet to the ejector assembly, the second wick having an upstream surface and a downstream surface, the upstream surface in direct contact with the downstream surface of the first wick across substantially the entire area of the upstream surface of the second wick; and a filter in direct contact with the downstream surface of the second wick.

13 Claims, 5 Drawing Sheets

FLUID INTERCONNECTION

CROSS-REFERENCE TO RELATED APPLICATIONS

Pursuant to 35 U.S.C. §119(a) and 365(b), the present application claims priority from PCT Application No. PCT/US2008/059545 entitled, "Fluid Interconnection" filed on Apr. 7, 2008, the disclosure of which is incorporated herein by reference in its entirety.

BACKGROUND

Inkjet printers typically utilize a printhead that includes an array of orifices (also called nozzles) through which ink is ejected on to paper or other print media. One or more printheads may be mounted on a movable carriage that traverses back and forth across the width of the paper feeding through the printer, or the printhead(s) may remain stationary during printing operations, as in a page width array of printheads. A printhead may be an integral part of an ink cartridge or part of a discrete assembly to which ink is supplied from a separate, often detachable ink container. For printhead assemblies that utilize detachable ink containers, it is important that the operative fluid connection between the outlet of the ink container and the inlet to the printhead assembly, commonly referred to as a fluid interconnection or "FI", provide reliable ink flow from the container to the printhead assembly.

Ink is drawn from the ink container through a filter on the inlet to the printhead assembly. Poor contact between the capillary material at the outlet of the ink container and the filter at the inlet to the printhead assembly in a conventional fluid interconnection may impede proper ink flow. Air leaking into the printhead assembly at this fluid interconnection may also impede ink flow. Thus, it is desirable that the fluid interconnection provide adequate contact in an airtight connection throughout repeated installations and removals of the ink container. The fluid inlet to the printhead assembly should also protect against losing backpressure and ink prime in the printhead assembly when an ink container is not installed, for example when the ink container is being changed.

DRAWINGS

DESCRIPTION

Embodiments of the disclosure were developed in an effort to improve the fluid interconnection between a printhead assembly and a detachable/replaceable ink container—to construct a fluid interconnection providing a robust, reliable ink flow interface throughout repeated installations and removals of the ink container while protecting against the loss of backpressure and ink prime in the printhead assembly when an ink container is removed and the printhead assembly inlet is exposed to the atmosphere. Embodiments will be described, therefore, with reference to an inkjet printhead assembly that holds detachable/replaceable ink containers. Embodiments of the disclosure, however, are not limited to such implementations. Embodiments of the disclosure, for example, might also be implemented in other types of ink or fluid dispensing components. The example embodiments shown in the Figures and described below, therefore, illustrate but do not limit the scope of the disclosure.

Figure 1:
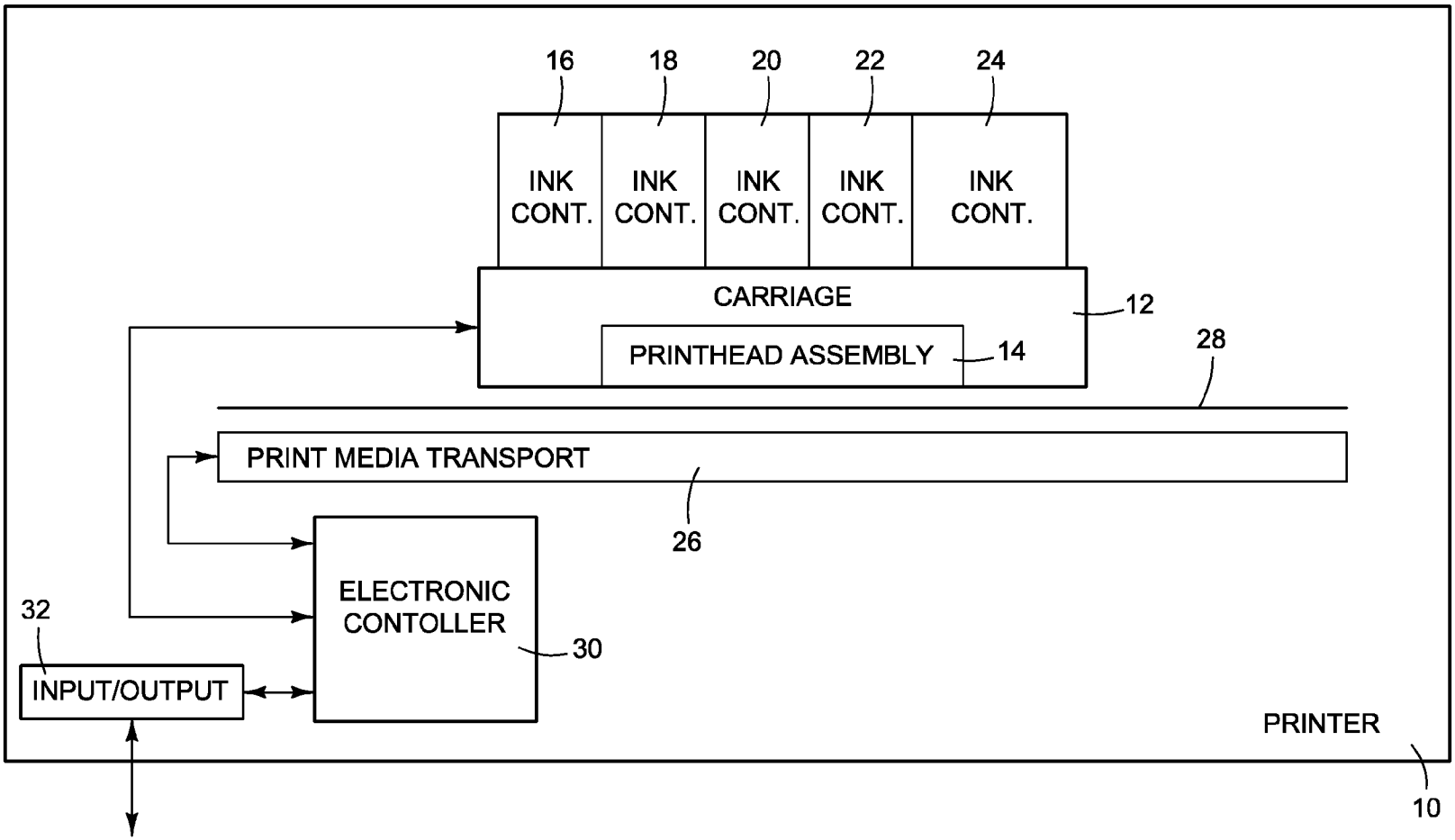
FIG. 1 is a block diagram illustrating an inkjet printer.

FIG. 1 is a block diagram illustrating an inkjet printer 10 in which embodiments of the disclosure may be implemented. Referring to FIG. 1, printer 10 includes a carriage 12 carrying a printhead assembly 14 and detachable ink containers 16, 18, 20, 22, and 24. Inkjet printer 10 and printhead assembly 14 represent more generally a fluid-jet precision dispensing device and fluid ejector assembly for precisely dispensing a fluid, such as ink, as described in more detail below. Printhead assembly 14 includes a printhead (not shown) through which ink from one or more containers 16-24 is ejected. For example, printhead assembly 14 may include two printheads—one for a series of color containers 16-22 and one for a black ink container 24. An inkjet printhead is typically a small electromechanical assembly that contains an array of miniature thermal, piezoelectric or other devices that are energized or activated to eject small droplets of ink out of an associated array of orifices. A typical thermal inkjet printhead, for example, includes a orifice plate arrayed with ink ejection orifices and firing resistors formed on an integrated circuit chip.

A print media transport mechanism 26 advances print media 28 lengthwise past carriage 12 and printhead assembly 14. For a stationary carriage 12, media transport 26 may advance media 28 continuously past carriage 12. For a movable, scanning carriage 12, media transport 26 may advance media 28 incrementally past carriage 12, stopping as each swath is printed and then advancing media 28 for printing the next swath.

An electronic controller 30 is operatively connected to a moveable, scanning carriage 12, printhead assembly 14 and media transport 26. Controller 30 communicates with external devices through an input/output device 32, including receiving print data for inkjet imaging. The presence of an input/output device 32, however, does not preclude the operation of printer 10 as a stand alone unit. Controller 30 controls the movement of carriage 12 and media transport 26. Controller 30 is electrically connected to each printhead in printhead assembly 14 to selectively energize the firing resistors, for example, to eject ink drops on to media 28. By coordinating the relative position of carriage 12 with media 28 and the ejection of ink drops, controller 30 produces the desired image on media 28.

While this Description is at least substantially presented herein to inkjet-printing devices that eject ink onto media, those of ordinary skill within the art can appreciate that embodiments of the present disclosure are more generally not so limited. In general, embodiments of the present disclosure pertain to any type of fluid-jet precision dispensing device or ejector assembly for dispensing a substantially liquid fluid. The fluid-jet precision dispensing device precisely prints or dispenses a substantially liquid fluid in that the latter is not substantially or primarily composed of gases such as air. Examples of such substantially liquid fluids include inks in the case of inkjet printing devices. Other examples of substantially liquid fluids include drugs, cellular products, organisms, chemicals, fuel, and so on, which are not substantially or primarily composed of gases such as air and other types of gases. Therefore, while the Description is described in relation to an inkjet printer and inkjet printhead assembly for ejecting ink onto media, embodiments of the present disclosure more generally pertain to any type of fluid-jet precision dispensing device or fluid ejector structure for dispensing a substantially liquid fluid.

Figure 2:
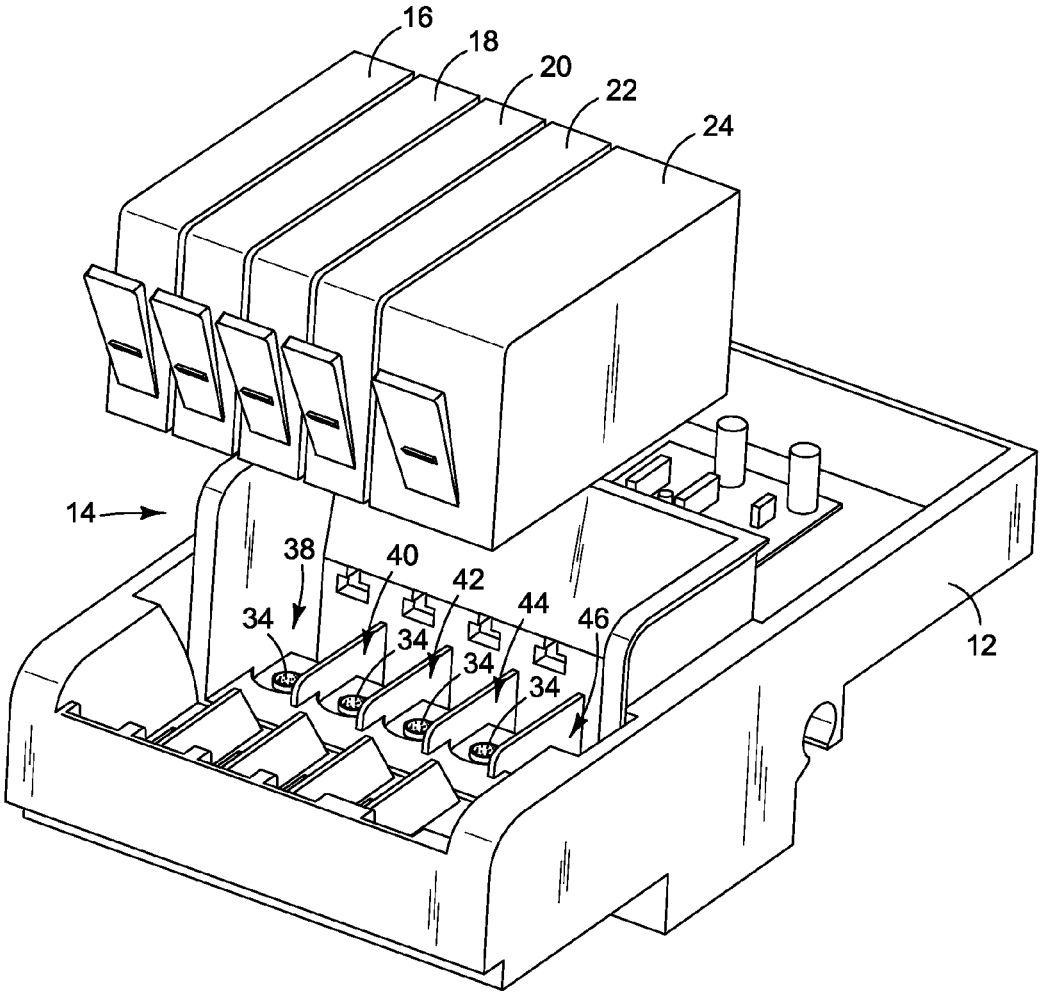
FIGS. 2 and 3 are perspective views of one embodiment of a carriage and printhead assembly, such as might be used in the printer of FIG. 1, with the ink containers exploded out from the carriage to show the inlets to the printhead assembly (FIG. 2) and the outlets from the ink containers (FIG. 3).
Figure 3:
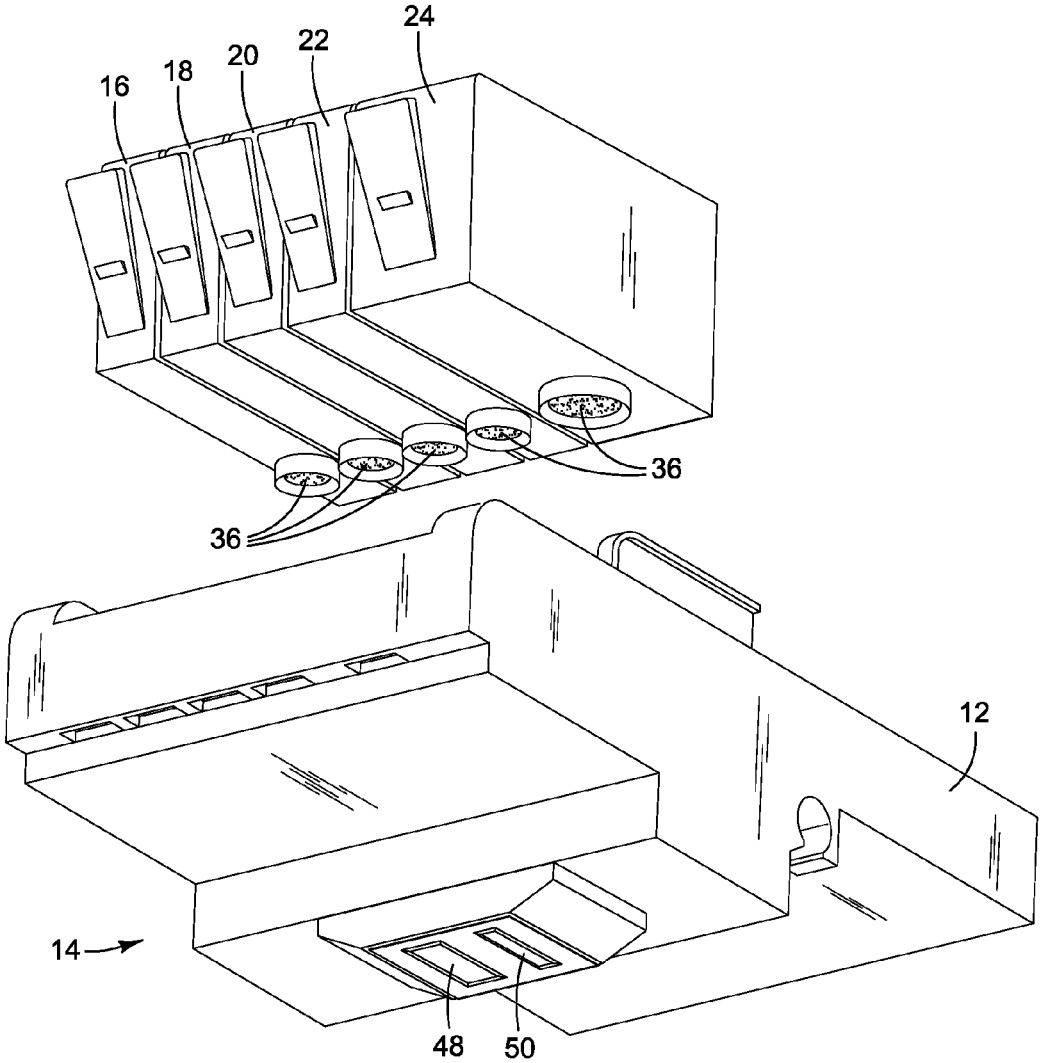

FIGS. 2 and 3 are perspective views of one embodiment of a carriage 12 and printhead assembly 14 in printer 10. Ink containers 16-24 are exploded out from carriage 12 to show ink inlets 34 to printhead assembly 14 (FIG. 2) and ink outlets 36 from ink containers 16-24 (FIG. 3). Referring to FIG. 2, printhead assembly 14 includes an ink inlet 34 positioned at each bay 38, 40, 42, 44, and 46 for a corresponding ink container 16-24. Printhead assembly 14 and carriage 12 may be integrated together as a single part or printhead assembly 14 may be detachable from carriage 12. For a detachable printhead assembly 14, container bays 38-46 may extend out into carriage 12 as necessary or desirable to properly receive and hold containers 16-24.

Referring to FIG. 3, in the embodiment shown, printhead assembly 14 includes two printheads 48 and 50. Ink from color ink containers 16-22, for example, is ejected from printhead 48 and ink from a black container 24 is ejected from printhead 50. Each ink container 16-24 includes an ink outlet 36 through which ink may flow from container 16-24 through an inlet 34 (FIG. 2) to a corresponding printhead 48 or 50 in printhead assembly 14.

Figure 4:
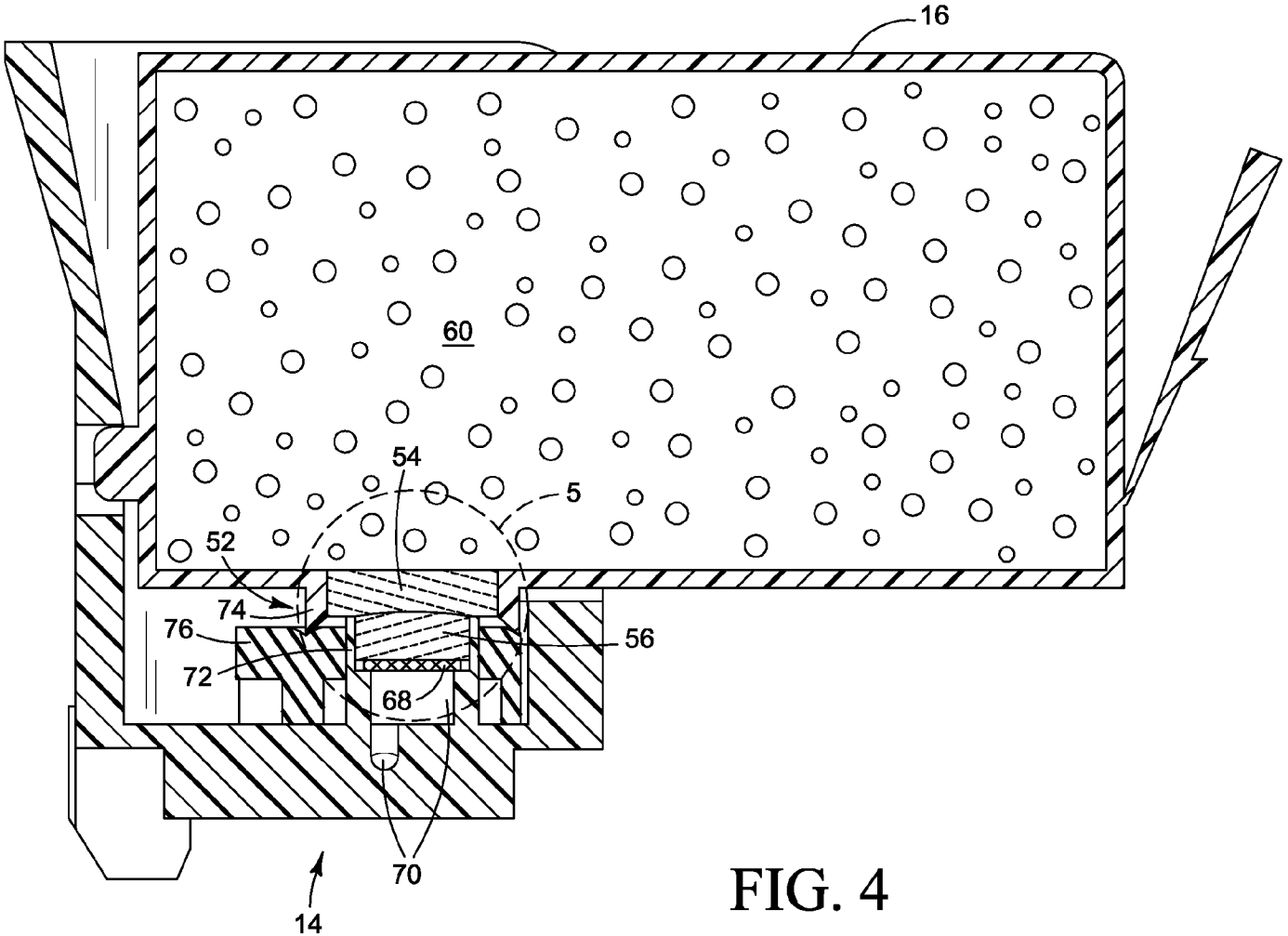
FIG. 4 is an elevation section view showing one embodiment of a fluid interconnection between an ink container and the printhead assembly.
Figure 5:
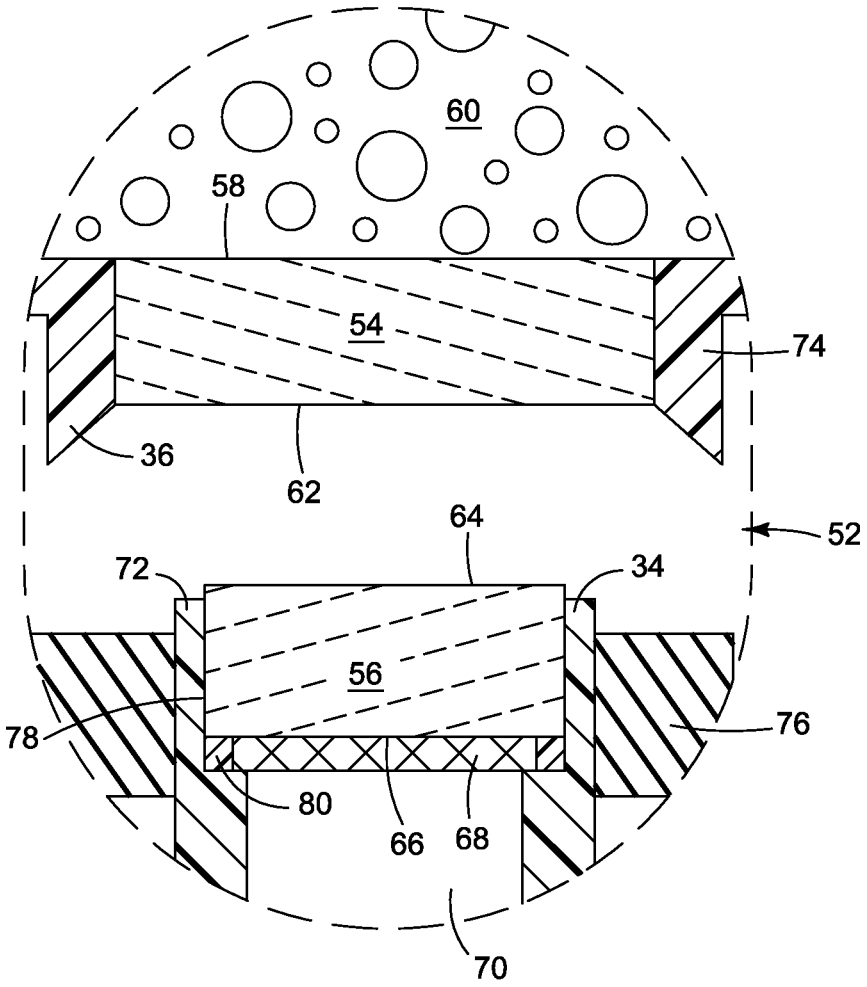
FIG. 5 is a detail exploded section view of the fluid interconnection shown in FIG. 4.

FIG. 4 is an elevation section view showing one embodiment of a fluid interconnection 52 between an ink container 16 and printhead assembly 14. FIG. 5 is a detail section view of fluid interconnection 52. Printhead assembly inlet 34 and container outlet 36 are shown exploded apart from one another in FIG. 5 to better illustrate some parts of interconnection 52. Referring to FIGS. 4 and 5, fluid interconnection 52 includes a wick 54 in container outlet 36 and a wick 56 at printhead assembly inlet 34. An upstream surface 58 of outlet wick 54 contacts foam or other ink holding material 60 in container 16. Alternatively, where an ink container 16 holds so-called "free ink", and there is no ink holding material, then upstream surface 58 will be exposed to the free ink in container 16. The downstream surface 62 of outlet wick 54 and the upstream surface 64 of inlet wick 56 are in contact with one another when container 16 is installed in printhead assembly 14. The downstream surface 66 of inlet wick 56 contacts a filter 68. An ink channel 70 downstream from filter 68 carries ink to printhead 48 (not shown).

Inlet wick 56 may protrude slightly from the top of an inlet tube 72, as shown, so that wicks 54 and 56 are compressed together slightly to optimize contact between uniformly wetted surfaces and, accordingly, help provide robust wick-to-wick ink flow. Also, wicks 54 and 56 made from the same materials, or otherwise having substantially the same wicking characteristics, will improve the consistency of the wetted contact surfaces to help improve ink flow. To function more effectively, wicks 54 and 56 should have a higher capillarity than the capillary media 60 in container 16 or, in a free ink container, having a capillarity sufficiently high to remain wetted while exposed when changing the ink container. The diameter (or other cross sectional dimension if not round) of downstream surface 62 of outlet wick 54 should be larger than that of upstream surface 64 of inlet wick 56 to reduce the risk of misalignment that might leave inlet wick 56 exposed to the atmosphere, thus reducing the risk of ingesting air into printhead assembly 14 through inlet wick 56.

Inlet tube 72 is sometimes referred to as an inlet "tower" 72 because it will usually extends out from the surrounding structure. Container outlet structure 74 fits around inlet tower 72 and seals against an elastomeric gasket or other suitable seal 76 to help prevent air from entering fluid interconnection 52. In the embodiment shown, inlet wick 56 and filter 68 are seated in a recess 78 along the inside perimeter of tower 72. Inlet wick 56 should be compressed slightly within tower 72 (i.e., an interference fit) and extend beyond the edges of filter 68, as shown, to help ensure that no outside air reaches filter 68 even when an ink container 16 is being changed and inlet wick 56 is temporarily exposed to the atmosphere—venting to the atmosphere through tower 72 may cause loss of backpressure in and depriming of printhead 48. In the embodiment shown, filter 68 is staked into position in tower recess 78 using a stake ring 80. Although filter 68 may be affixed to tower 72 using any suitable technique or structural configuration, the resulting structure should allow inlet wick 56 to overlap the edge(s) of filter 68 by at least 1 mm to help protect against unwanted venting.

The wick-to-wick interface of fluid interconnection 52 helps prevent "installation drool" in which ink drools from the printhead orifices as air is pushed into the printhead when an ink container is installed on to the printhead assembly tower. In addition, once the inlet wicks 56 are wetted and the printheads 48 and 50 primed with ink, inlet wick 56 will effectively seal each inlet 34 from the atmosphere during container changes, maintaining proper backpressure and thus allowing printheads 48 and 50 to stay primed and not drool. Unlike some conventional fluid interconnects in which the filter sits atop the inlet tower, exposed to the ink container outlet structure, inlet wick 56 in fluid interconnection 52 protects filter 68 from damage by container outlet structure 74 when a container is installed in and removed from printhead assembly 14.

As noted at the beginning of this Description, the example embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A fluid interconnection between a fluid container and a fluid ejector assembly, comprising:

a first wick at an outlet from the container, the first wick having an upstream surface and a downstream surface;

a second wick at an inlet to the ejector assembly, the second wick having an upstream surface and a downstream surface, the upstream surface of the second wick in direct contact with the downstream surface of the first wick across substantially the entire area of the upstream surface of the second wick; and a filter in direct contact with the downstream surface of the second wick.

2. The fluid interconnection of claim 1, wherein the downstream surface of the first wick and the upstream surface of the second wick are compressed together.

3. The fluid interconnection of claim 1, wherein the downstream surface of the first wick has a cross sectional dimension larger than a cross sectional dimension of the upstream surface of the second wick.

4. The fluid interconnection of claim 1, wherein the first wick and the second wick have substantially the same wicking characteristics.

5. The fluid interconnection of claim 1, further comprising a fluid holding material in the container, the fluid holding material in direct contact with the upstream surface of the first wick.

6. The fluid interconnection of claim 1, further comprising a seal operatively connected between the inlet and the outlet to seal off the wicks from the atmosphere.

7. The fluid interconnection of claim 1, wherein the fluid container comprises an ink container and the fluid ejector structure comprises an inkjet printhead assembly.

8. The fluid interconnection of claim 7, further comprising an ink holding material in the ink container, the ink holding material in direct contact with the upstream surface of the first wick.

9. A fluid interconnection between a fluid container and a fluid ejector assembly in which fluid flows from the container through a first interface between a fluid holding material in the container and an outlet wick at an outlet from the container, and then through a second interface between the outlet wick and an inlet wick at an inlet to the assembly, and then through a third interface between the inlet wick and a filter within the assembly, in which the outlet wick and the inlet wick have substantially the same wicking characteristics.

10. A fluid ejector assembly, comprising:

an inlet tube having an exposed open end through which fluid may enter the assembly;

a conduit through which fluid may pass from the inlet tube to an ejector structure;

a filter in the inlet tube such that fluid passing through the inlet tube to the conduit passes through the filter;

a wick in the inlet tube such that fluid entering the inlet tube passes through the wick, the wick having a downstream surface in contact with the filter and:

an upstream surface of the wick protruding from the open end of the inlet tube, a cross sectional dimension of the wick at the downstream surface greater than a cross-section dimensional of the filter such that a perimeter of the downstream surface of the wick extends beyond a perimeter of the filter, and an interference fit between the wick and the inlet tube such that the wick is compressed in the inlet tube.

11. The assembly of claim 10, wherein the interference fit is created with the wick having a cross sectional dimension slightly larger than an inside dimension of the inlet tube.

12. The assembly of claim 10, wherein the filter and the wick are supported in a recess in an inside surface of the inlet tube.

13. The assembly of claim 10, wherein the fluid ejector assembly comprises an inkjet printhead assembly and the fluid comprises ink, the assembly further comprising:

a bay for holding a detachable ink container, the inlet tube having an exposed open end through which ink from an ink container installed in the bay may enter the assembly; and a printhead from which ink may be ejected from the assembly, the conduit through which ink may pass from the inlet tube to the printhead.

* * * * *